US009045841B1

(12) United States Patent
Buckalew et al.

(10) Patent No.: US 9,045,841 B1
(45) Date of Patent: Jun. 2, 2015

(54) CONTROL OF ELECTROLYTE COMPOSITION IN A COPPER ELECTROPLATING APPARATUS

(75) Inventors: Bryan Buckalew, Tualatin, OR (US); Jonathan Reid, Sherwood, OR (US); John Sukamto, Lake Oswego, OR (US); Zhian He, Tigard, OR (US); Seshasayee Varadarajan, Lake Oswego, OR (US); Steven T. Mayer, Lake Oswego, OR (US)

(73) Assignee: Novellus Systems, Inc., Fremont, CA (US)

( * ) Notice: Subject to any disclaimer, the term of this patent is extended or adjusted under 35 U.S.C. 154(b) by 799 days.

(21) Appl. No.: 13/359,343

(22) Filed: Jan. 26, 2012

Related U.S. Application Data

(62) Division of application No. 11/590,413, filed on Oct. 30, 2006, now Pat. No. 8,128,791.

(51) Int. Cl.
*C25D 3/02* (2006.01)
*C25D 21/14* (2006.01)

(52) U.S. Cl.
CPC ..... *C25D 21/14* (2013.01)

(58) Field of Classification Search
CPC ..... C25D 3/02; C25D 21/14
USPC ..... 204/193, 194, 232–237, 280, 600, 204/622–626; 205/80–233
See application file for complete search history.

(56) References Cited

U.S. PATENT DOCUMENTS

| | | | | |
|---|---|---|---|---|
| 3,664,440 | A * | 5/1972 | Elenburg | 175/206 |
| 4,105,532 | A | 8/1978 | Haines et al. | |
| 5,200,065 | A | 4/1993 | Sinclair et al. | |
| 6,126,798 | A | 10/2000 | Reid et al. | |
| 6,156,167 | A | 12/2000 | Patton et al. | |
| 6,333,275 | B1 | 12/2001 | Mayer et al. | |
| 6,458,262 | B1 | 10/2002 | Reid | |
| 6,527,920 | B1 | 3/2003 | Mayer et al. | |
| 6,569,299 | B1 | 5/2003 | Reid et al. | |
| 6,726,824 | B1 | 4/2004 | Khosla | |
| 6,800,187 | B1 | 10/2004 | Reid et al. | |
| 6,878,245 | B2 | 4/2005 | Gandikota et al. | |
| 6,890,416 | B1 | 5/2005 | Mayer et al. | |
| 6,989,084 | B2 | 1/2006 | Tench et al. | |
| 7,178,410 | B2 | 2/2007 | Fraden et al. | |
| 2004/0065540 | A1 | 4/2004 | Mayer et al. | |
| 2006/0086616 | A1 | 4/2006 | Kurashina et al. | |

(Continued)

OTHER PUBLICATIONS

U.S. Appl. No. 11/895,911, Buckalew et al., filed Aug. 27, 2007, "Real-Time Monitoring of Anolyte System Integrity for a Copper Electroplating Tool".

(Continued)

*Primary Examiner* — Susan D Leong
(74) *Attorney, Agent, or Firm* — Weaver Austin Villeneuve & Sampson LLP

(57) ABSTRACT

In a copper electroplating apparatus having separate anolyte and catholyte portions, the concentration of anolyte components (e.g., acid or copper salt) is controlled by providing a diluent to the recirculating anolyte. The dosing of the diluent can be controlled by the user and can follow a pre-determined schedule. For example, the schedule may specify the diluent dosing parameters, so as to prevent precipitation of copper salt in the anolyte. Thus, precipitation-induced anode passivation can be minimized.

19 Claims, 4 Drawing Sheets

(56) References Cited

U.S. PATENT DOCUMENTS

| | | | | |
|---|---|---|---|---|
| 2006/0144700 | A1 * | 7/2006 | Carson et al. | 204/252 |
| 2006/0144712 | A1 | 7/2006 | Klocke | |

OTHER PUBLICATIONS

U.S. Office Action for U.S. Appl. No. 11/590,413 mailed Aug. 28, 2009.
U.S. Final Office Action for U.S. Appl. No. 11/590,413 mailed Feb. 5, 2010.
U.S. Office Action for U.S. Appl. No. 11/590,413 mailed Apr. 19, 2010.
U.S. Office Action for U.S. Appl. No. 11/590,413 mailed Aug. 6, 2010.
U.S. Final Office Action for U.S. Appl. No. 11/590,413 mailed Feb. 2, 2011.
U.S. Office Action for U.S. Appl. No. 11/895,911 mailed Feb. 18, 2011.
Notice of Allowance for U.S. Appl. No. 11/590,413 mailed Oct. 27, 2011.

* cited by examiner

CONTROL OF ELECTROLYTE COMPOSITION IN A COPPER ELECTROPLATING APPARATUS

CROSS-REFERENCE TO RELATED APPLICATIONS

This application is a divisional application claiming priority from U.S. patent application Ser. No. 11/590,413 filed Oct. 30, 2006, titled "Control of Electrolyte Composition in a Copper Electroplating Apparatus", naming Buckalew et al. as inventors, which is incorporated herein by reference in its entirety for all purposes.

FIELD OF THE INVENTION

The present invention relates generally to a method and apparatus for treating the surface of a substrate and more particularly to a method and apparatus for electroplating a layer on a semiconductor wafer. It is particularly useful for electroplating copper in Damascene and dual Damascene integrated circuit fabrication methods.

BACKGROUND OF THE INVENTION

Manufacturing of semiconductor devices commonly requires deposition of electrically conductive material on semiconductor wafers. The conductive material, such as copper, is often deposited by electroplating onto a seed layer of metal deposited onto the wafer surface by a PVD or CVD method. Electroplating is a method of choice for depositing metal into the vias and trenches of the processed wafer during Damascene and dual Damascene processing.

Damascene processing is used for forming interconnections on integrated circuits (ICs). It is especially suitable for manufacturing copper interconnections. Damascene processing involves formation of inlaid metal lines in trenches and vias formed in a dielectric layer (inter-metal dielectric). In a typical Damascene process, a pattern of trenches and vias is etched in the dielectric layer of a semiconductor wafer substrate. A thin layer of diffusion-barrier film such as tantalum, tantalum nitride, or a TaN/Ta bilayer is then deposited onto the wafer surface by a PVD method, followed by deposition of seed layer of copper on top of the diffusion-barrier layer. The trenches and vias are then electrofilled with copper, and the surface of the wafer is planarized to remove excess copper.

The vias and trenches are electrofilled in an electroplating apparatus, such as the SABRE™ clamshell electroplating apparatus available from Novellus Systems, Inc. of San Jose, Calif., and described in U.S. Pat. No. 6,156,167, which is incorporated herein by reference in its entirety. Electroplating apparatus includes a cathode and an anode immersed into an electrolyte contained in the plating vessel. The cathode of this apparatus is the wafer itself, or more specifically, its copper seed layer and the deposited copper layer. The anode may be a disc composed of, e.g., phosphorus-doped copper. The composition of electrolyte that is used for deposition of copper may vary, but usually includes sulfuric acid, copper salt (e.g. $CuSO_4$), chloride ions, and a mixture of organic additives. The electrodes are connected to a power supply, which provides the necessary voltage to electrochemically reduce cupric ions at the cathode, resulting in deposition of copper metal on the surface of the wafer seed layer.

The composition of plating solution is selected so as to optimize the rates and uniformity of electroplating. Copper salt serves as a source of plated copper and also provides conductivity to the plating solution. Sulfuric acid enhances plating solution conductivity by providing protons as current carriers, and, therefore, allows electrodeposition of copper at reduced applied voltages. Organic additives, known as accelerators, suppressors and levelers, are capable of selectively enhancing or suppressing rates of deposition of copper on different surfaces of the wafer features, thereby improving the uniformity of deposition. Chloride ion is useful for modulating the effect of organic additives and is commonly added to the plating bath for this purpose.

It is often advantageous to separate anodic and cathodic regions of the plating cell by a membrane because processes occurring at the anode and the cathode during electroplating are not always compatible. For example, during use, insoluble particles resulting from flaking of the anode, or from precipitation of inorganic salts may be formed at the anode. It is desirable to protect the wafer from these particles, so that they would not interfere with the metal deposition process and would not contaminate the wafer. In another example, it may be desirable to confine organic additives to the cathodic portion of the plating cell, so that they would not contact the anode. Organic additives used for modulation of deposition rates often contain thiol groups and are prone to oxidative decomposition at the anode surface, resulting in anode passivation.

A suitable separating membrane would allow the flow of ions, and, hence the current, between the anodic and cathodic regions of the plating cell, but will block larger particles, and some non-ionic molecules, such as organic additives from crossing it. By doing so, the membrane essentially will create different environments in the cathodic and the anodic regions of the plating cell. The isolated anodic region of the plating cell is often referred to as a separate anode chamber (SAC) and electrolyte within it is known as anolyte. The electrolyte contained in the plating bath across the membrane from the SAC is referred to as catholyte.

Electroplating apparatus having membrane-separated cathode and anode chambers achieves separation of catholyte and anolyte and allows them to have distinct compositions. For example, organic additives can be contained within catholyte, while the anolyte can remain essentially additive-free. Further, anolyte and catholyte may have differing concentrations of copper sulfate and sulfuric acid, due, for example, to ionic selectivity of the membrane. An electroplating apparatus having a membrane is described in detail in U.S. Pat. No. 6,527,920 issued to Mayer et al., which is herein incorporated by reference for all purposes.

The membrane separating catholyte and anolyte may have different selectivity for different cations. For example, it may allow passage of protons at a faster rate than the passage rate of cupric ions. During electroplating, the current can be carried between the anode and the cathode by any cationic species, e.g. by both protons and copper ions. However, depending on the selectivity of the membrane, mobility of the ions or other factors, the current may be predominantly carried by protons, until a certain molar ratio between $Cu^{2+}$ and $H^+$ concentrations is achieved. After this ratio is achieved, copper ions start crossing the membrane and carrying the current along with the protons. Therefore, until a certain molar ratio between copper ions and hydrogen ions is achieved, the anolyte is being continuously depleted of its acidic component, since the protons are the main current carriers under these conditions. While concentration of acid in the anolyte is being continuously decreased, the concentration of copper salt is increased, especially when a copper-containing anode is used.

These processes may result in several undesired effects in the plating system. First, if solubility limit of copper salt is reached before cupric ions start carrying the current and start leaving the anolyte, the copper salt would precipitate in the anode chamber. This salting out may cause passivation of the anode, which is characterized by deposition of copper salt on the anode surface. Clogging of filters in the anolyte recirculation loop is also occurring as a result of copper salt precipitation.

Further, the separation of cathodic and anodic regions by a membrane creates an electroosmotic effect in which the protons crossing the membrane from the anode chamber to the cathodic portion of the apparatus "drag" water molecules in the same direction thereby depleting the anolyte volume and increasing the volume in the cathode chamber. This effect is known as electroosmotic drag and is undesired since it creates a pressure gradient between the two chambers that can lead to membrane damage and failure.

The salting out effect can be alleviated to some extent by replenishing the anolyte continuously with the fresh electrolyte and by disposing of or reconstituting the old electrolyte that has high copper salt concentration. This method is known as bleed and feed method. While it is generally desirable to refresh small percentage of anolyte by bleed and feed method, it is not an economically feasible method for solving copper salt precipitation problem. High bleed and feed rates are generally needed to maintain acceptable copper concentration in the anolyte, resulting in large volumes of electrolyte being wasted. Therefore, operation cost of electroplating apparatus becomes very high when high bleed and feed rates are used.

It is desirable to be able to control composition of the electrolyte in a more economical fashion. Accordingly, a method of such control, and an apparatus allowing practice of such a method, are needed.

SUMMARY

The present invention addresses these needs by providing an electroplating method and an electroplating apparatus that allow control over electrolyte composition in a cost-effective fashion. In a copper electroplating apparatus having separate anolyte and catholyte portions, concentration of anolyte components (e.g., acid or copper salt) is controlled by providing a diluent to the anolyte. The dosing of the diluent can be controlled by the user and can follow a pre-determined schedule. For example, the schedule may specify the dosing, so as to prevent precipitation of copper salt in the anolyte or to compensate for water lost during electroosmotic drag. Typically, high anolyte bleed and feed rates are not needed when diluent is used to control the anolyte composition. Thus, it is possible to prevent salting out in the anolyte and associated anode passivation without consuming large amounts of bleed and feed electrolyte.

In one aspect, the invention provides a method of controlling the composition of an electrolyte bath for electroplating of copper onto a partially fabricated integrated circuit wafer. In this method, one or more wafers are sequentially provided to a catholyte portion of a plating cell having an anode chamber with recirculating anolyte. The anode chamber, for example, may include a cation exchange membrane in ionic contact with the catholyte portion of the plating cell. After it has been determined that the anolyte needs to be diluted, a diluent is provided to the recirculating anolyte. For example, the diluent may be provided directly to recirculating anolyte via a diluent port.

Typically, the recirculating anolyte includes an acidic solution of copper salt. Preferably, the diluent is added at a level sufficient to maintain a concentration of copper salt below a point where the copper salt will precipitate. One can determine that the anolyte needs to diluted by, for example, following a preset schedule for diluting the anolyte. For instance, the anolyte may be diluted after a defined number of wafers have been processed, or after a defined amount of current has passed through the wafers.

In some embodiments, a make up solution is also provided to the recirculating anolyte. For example, the make up solution and the diluent can be provided to the anolyte in a defined ratio. There is a variety of ways that may be used to introduce make up solution and the diluent to the recirculating anolyte. In one example, the make up solution is provided to the recirculating anolyte directly via a make up solution port. In one embodiment, addition of diluent to the anolyte may include the following operations. In the first operation, the diluent is provided to the make up solution in order to dilute the make up solution and to produce diluted make up solution. In the second operation, the obtained diluted make up solution is directly provided to the recirculating anolyte. In one specific embodiment of this method, a third operation of directly providing the diluent to the recirculating anolyte is included.

While the methods of present invention can achieve good control over electrolyte component concentrations by adding a diluent to the anolyte, in some embodiments it is advantageous to supplement these methods by bleeding and feeding of anolyte from the recirculating anolyte, in order to refresh the anolyte solution. During anolyte bleed and feed, the anolyte bleed may be removed from the anode chamber in a number of ways. For example, it may be discarded to an anolyte drain or it may be introduced to the catholyte recirculation loop and reused as a catholyte.

In some embodiments, the methods of electrolyte composition control also may include recirculating the catholyte or providing a diluent and a make up solution directly to the catholyte.

In another aspect, the invention provides a plating cell for plating copper onto partially fabricated integrated circuit wafers. In one embodiment, the plating cell includes a catholyte portion adapted for receiving wafers in a catholyte; a separate anode chamber for holding an anode and maintaining an anolyte in ionic communication with the catholyte; a recirculation system of the anolyte; a make up solution entry port for directly dosing the recirculating anolyte with make up solution; a diluent entry port for dosing recirculating anolyte or the make up solution with a diluent; and a controller for separately controlling delivery of the diluent and the make up solution to the recirculating anolyte. The diluent entry port may be configured to directly dose the recirculating anolyte with diluent. The diluent port may also be configured to directly dose the make up solution with diluent.

The plating cell may further include a cation exchange membrane on the separate anode chamber, wherein the cation exchange membrane provides a path for the ionic communication between the anolyte and the catholyte.

Further, the plating cell may include a port for bleeding the catholyte and a port for feeding the catholyte. In some embodiments, a recirculation system for catholyte may also be included. The catholyte recirculation system may have separate diluent and make up solution ports.

These and other features and advantages of the present invention will be described in more detail below with reference to the associated drawings.

DETAILED DESCRIPTION OF A PREFERRED EMBODIMENT

The present invention provides a method and an apparatus for controlling anolyte composition. In particular, it allows control of concentrations of anolyte components by providing a diluent to the anolyte. The anolyte is contained within the anode chamber in an electroplating apparatus and is separated from the catholyte by a membrane. The anolyte is recirculated in an anolyte recirculation loop so that the anolyte is returned to the anode chamber upon a treatment, e.g. filtration, dilution or addition of make up solution. Dilution of the anolyte can be accomplished as needed by the user. For example, a diluent may be added to the anolyte in order to decrease concentration of a metal salt, so that it does not precipitate in the anode chamber. In another example, the anolyte may be diluted to compensate for electroosmotically lost water. In one of the embodiments, the anolyte composition is additionally controlled by a bleed and feed method, in which make up solution that contains metal salt is provided to the anolyte, and excess of used anolyte is disposed of to an anolyte drain or introduced to the catholyte recirculation loop.

By employing anolyte composition control of the present invention, it is possible to reduce precipitation-induced anode passivation without substantially increasing the bleed and feed rates. It is also possible to avoid membrane damage by controlling the pressure gradient across the membrane through addition of diluent to the anolyte. It is especially advantageous to use anolyte control for electrolyte compositions that rely on protons rather than metal ions as primary current carriers. For example, this invention is particularly suitable for controlling copper salt concentration in medium and high-acid electrolytes, e.g., in electrolytes with a sulfuric acid concentration of about 50-180 g/L. In general, the invention reduces the costs of electroplating apparatus operation, provides a higher reliability to the plating process, and allows plating at a greater range of electrolyte compositions.

The diluent may be provided to the anolyte in a variety of ways. In some embodiments, it may be added through a diluent port directly to the anolyte. For example, it may be provided to the anolyte recirculation loop, to the anode chamber or to the interface between the loop and the chamber. It may also be pre-mixed with other components provided to the anolyte, thereby diluting these components. For example, the diluent may be added to the make-up electrolyte solution provided to the anolyte recirculation loop. Examples of electroplating apparatus configurations allowing to control concentrations of anolyte components are presented in FIGS. 1A and 1B.

Figure 1A:
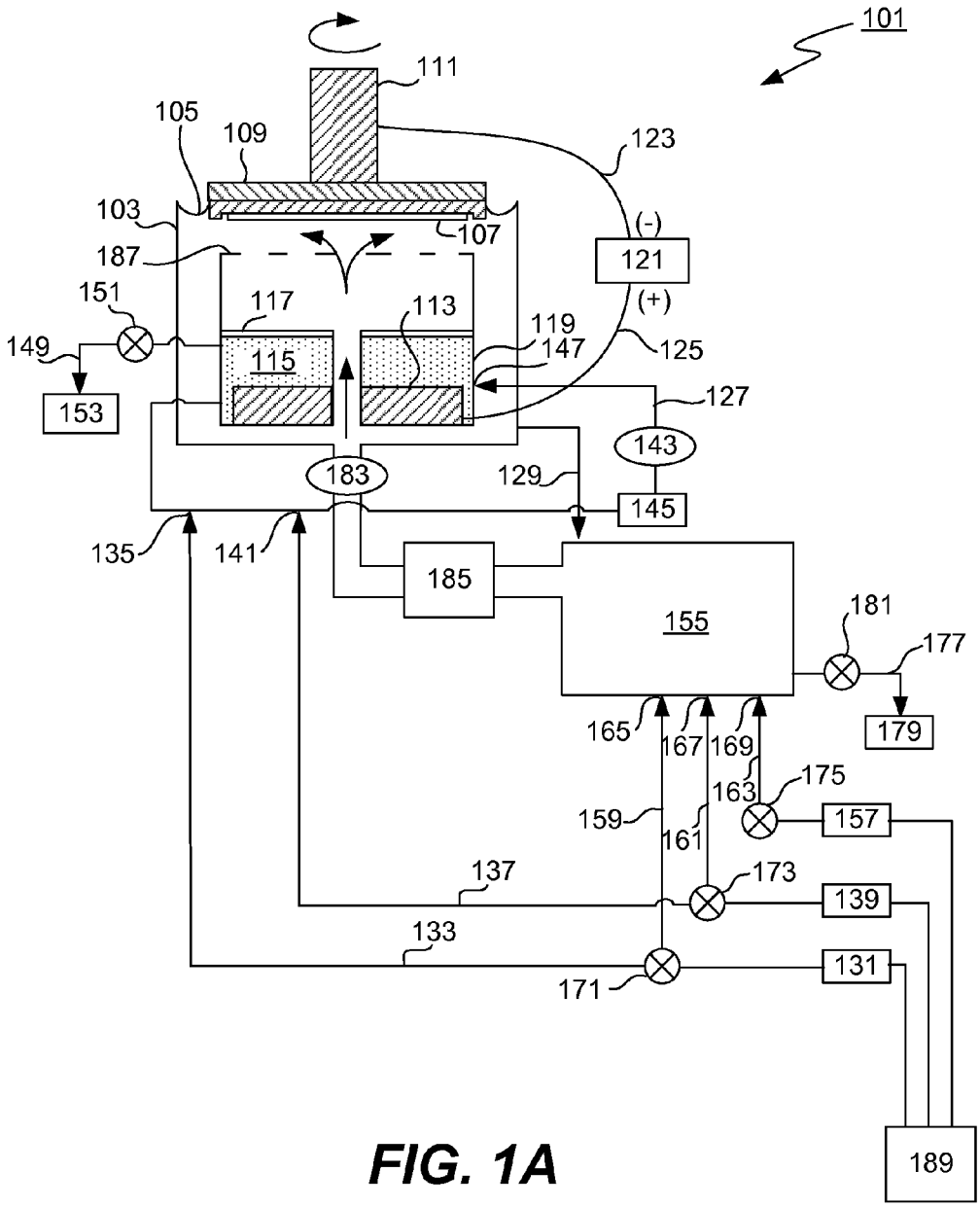
FIG. 1A is a diagrammatic cross-sectional view of one embodiment of an electroplating apparatus in accordance with the present invention.

Referring to FIG. 1A, a diagrammatical cross-sectional view of an electroplating apparatus 101 is shown. The plating vessel 103 contains the plating solution, which is shown at a level 105. The catholyte portion of this vessel is adapted for receiving wafers in a catholyte. A wafer 107 is immersed into the catholyte and is held by a "clamshell" holding fixture 109, mounted on a rotatable spindle 111, which allows rotation of clamshell 109 together with the wafer 107. A general description of a clamshell-type plating apparatus having aspects suitable for use with this invention is described in detail in U.S. Pat. No. 6,156,167 issued to Patton et al., and U.S. Pat. No. 6,800,187 issued to Reid et al, which are incorporated herein by reference for all purposes. An anode 113, which may be active or inert, is disposed below the wafer within the separate anode chamber 115, and is separated from the cathode by a membrane 117, preferably an ion exchange membrane (e.g. a Nafion cationic exchange membrane). An anode chamber 115 is defined by the walls of an anode cup 119 and by the membrane 117. A channel, that is a part of catholyte recirculation loop may run through the anode chamber in some embodiments. The separate anode chamber 115 contains anolyte, which communicates with the catholyte through the membrane 117. The catholyte is contained within the plating bath outside of the anode chamber. The term "plating bath" as used in this application refers to catholyte-containing portion of the apparatus.

The membrane 117 allows ionic communication between the anodic and cathodic regions of the plating cell, while preventing the particles generated at the anode from entering the proximity of the wafer and contaminating it. Detailed descriptions of suitable anodic membranes are provided in U.S. Pat. Nos. 6,126,798 and 6,569,299 issued to Reid et al., both incorporated herein by reference for all purposes. Ion exchange membranes, such as cationic exchange membranes are especially suitable for these applications. These membranes are typically made of ionomeric materials, such as perfluorinated co-polymers containing sulfonic groups (e.g. Nafion), sulfonated polyimides, and other materials known to those of skill in the art to be suitable for cation exchange. Selected examples of suitable Nafion membranes include N324 and N424 membranes available from Dupont de Nemours Co.

The wafer 107 and the anode 113 are electrically connected to a DC power supply 121 by a negative lead 123 and a positive lead 125 respectively. During use, the wafer is biased negatively with respect to the anode, and a current flux of positive ions is created in the electrolyte. The direction of the current as used herein is the direction of net positive ion flux. During electroplating, the current flows from the anode to the wafer (cathode) and an electrochemical reduction (e.g. $Cu^{2+}+2\ e^{-}=Cu^{0}$ occurs on the wafer surface.

Referring to copper plating, the current flux can be carried by protons, cupric ions or both. When $Cu^{2+}/H^{+}$ molar ratio in the anolyte is not very high, the protons are the primary carriers of the current. When this ratio exceeds a certain value, cupric ions start carrying the current from the anode 113 to the wafer 107. This ratio may vary for different plating systems and depends on intrinsic characteristics of the ions (e.g. mobility and valence) as well as on extrinsic properties of the plating system (e.g. ionic selectivity of the membrane). For example, when N324 Nafion membrane is used, cupric ions do not start crossing the membrane during plating until an 8:1 $Cu^{2+}/H^{+}$ ratio is achieved. As it has been mentioned, the solubility limit of copper salt can be reached in the anolyte before cupric ions start carrying the current. This results in precipitation of copper salt in the anode chamber (salting out) and may lead to passivation of the anode. As it can be seen from the $Cu^{2+}/H^{+}$ ratio, the anolyte is especially prone to salting out if it contains acid in medium or high concentrations relative to concentration of copper salt. Salting out can be avoided if metal salt concentration is reduced by dilution, or if it is maintained at appropriate level by high bleed and feed rate. It is preferable to use both dilution and bleed and feed methods in order to achieve economically feasible anolyte control. In addition, anolyte composition can be controlled by using a CEM with an appropriate ion selectivity. For example, membranes that require lower $Cu^{2+}/H^{+}$ ratios for $Cu^{2+}$ transfer during plating may be used. Further, some types of membranes may be useful for reducing electroosmotic drag and the pressure gradient associated with it. For example certain membranes may reduce flux of water accompanying the flux of $H^{+}$ ions traveling from the anode chamber to the plating bath. Certain Nafion membranes, such as N324 Nafion membrane available from Dupont de Nemours Co. can be used for this purpose. Other types of selective membranes known to those skilled in the art can also be employed.

Referring again to FIG. 1A, an embodiment of a plating apparatus having an anolyte recirculation loop 127 and a catholyte recirculation loop 129 is presented. In this embodiment the diluent is provided from the diluent source 131 directly to the anolyte in the anolyte recirculation loop 127. In other embodiments the diluent can be provided directly to the anode chamber 115 or to the interface between the recirculation loop and the anode chamber. The diluent is provided by a diluent line 133 through a diluent port 135. A separate line 137 carrying virgin make up solution (VMS) solution from the VMS source 139, provides VMS to the anolyte recirculation loop 127 via a VMS port 141. The VMS providing structure is also referred to as a feed structure used in the anolyte bleed and feed. After the diluent and VMS have been added as needed to the recirculating anolyte, the anolyte is filtered by a filter 143 and is returned back to the anode chamber 115 by a pump 145 through an anolyte entry port 147. A bleed line 149 controlled by a bleed valve 151 allows to remove excess of used anolyte and to discard it to the anolyte drain 153.

In one embodiment, the catholyte is recirculated in a separate recirculation loop 129. The catholyte is provided from the plating bath 103 to the catholyte reservoir 155. A diluent, a make up solution, and organic additives can be added directly to the catholyte reservoir 155 from sources 131, 139, and 157 via lines 159, 161, 163 and through ports 165, 167, and 169 respectfully. Valves 171 and 173 control the dosing of the diluent and the VMS respectfully. The valves 171 and 173 can provide the diluent and the VMS both to the anolyte and catholyte loops so that the dosing to both of these loops can be independently controlled. Organic additives in the presented embodiment are added to the catholyte recirculation loop only. It is preferable to avoid contacting the anode with organic additives because of the risk of oxidative decomposition of additives at the anode surface. Therefore, a membrane that blocks the additives from entering the separate anode chamber may be used in order to contain these additives within catholyte. Dosing of organic additives is controlled by the valve 175.

Excess of used catholyte can be discarded via a bleed line 177 to a catholyte drain 179. The amount of discarded catholyte can be controlled by a bleed valve 181. The described bleed structure together with the VMS dosing feed structure are the main components of the catholyte bleed and feed system.

Upon addition of different components as required, the catholyte is filtered by a filter 183 and is provided to the catholyte portion of the plating cell (also referred to as plating bath) by a pump 185. When provided to the plating bath, the catholyte typically flows upwards through a high impedance separator plate 187 to the center of wafer 107 and then radially outward and across wafer 107. A high impedance separator is used for shaping the electric field at the wafer surface and is typically a disc made of dielectric material having multiple perforations. It should be recognized that the plating cell may contain other elements, such as field-shaping shields or virtual anodes, that are not shown in the figure in order to preserve clarity but are well known to those of skill in the art and can be used in conjunction with the present invention.

The dosing of components to the anolyte and catholyte recirculation loops of the plating apparatus can be controlled by a controller 189. The controller may be manually controlled or it may include a preset schedule, e.g., program instructions, specifying the dosing parameters. For example, the schedule may specify the parameters for dosing a diluent and VMS to the anolyte. The parameters may include the amounts of diluent or VMS to be added and the times at which the addition should occur. Further, the controller can control bleed and feed rates both in the anolyte and the catholyte loops.

Figure 1B:
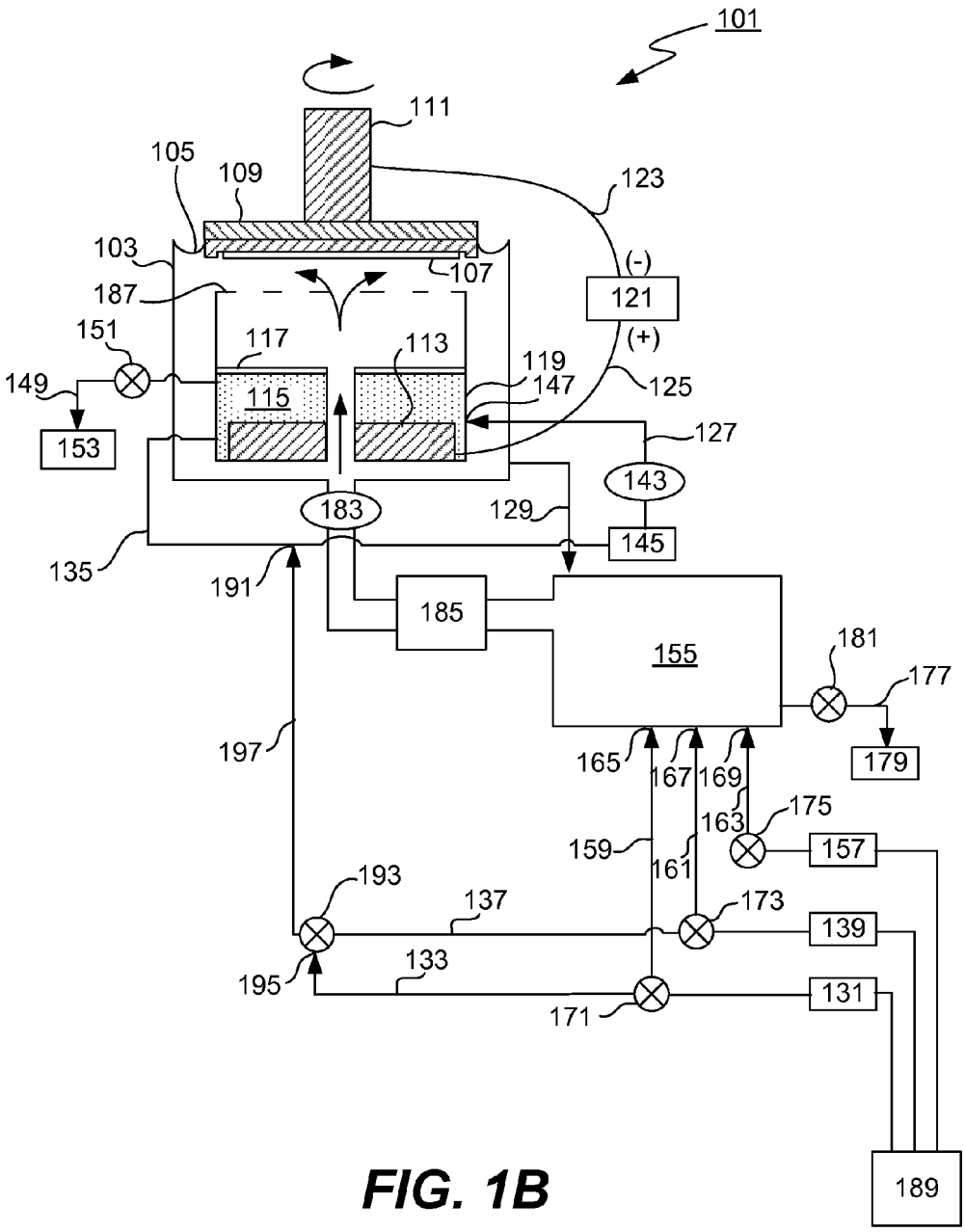
FIG. 1B is a diagrammatic cross-sectional view of another embodiment of an electroplating apparatus in accordance with the present invention.

It should be recognized that there are a variety of ways a diluent may be added to the anolyte, and a variety of plumbing configurations can address this task. For illustrative purposes, one embodiment of the plating apparatus having a different plumbing configuration of recirculation loops is presented. FIG. 1B shows a cross-sectional diagrammatic view of an electroplating apparatus in accordance with this embodiment. The apparatus shown in FIG. 1B is different from an embodiment shown in Figure lA in that it lacks a separate diluent port 135. Instead, the diluent is provided from the diluent source 131 through diluent port 195 to the line 197. The line 197 is connected to the diluent line 133 and to a VMS line 137 through a three-way valve. The valve allows to add diluent directly to the anolyte, or directly to VMS, as desired. Therefore, a diluent, a diluted VMS solution, or concentrated VMS solution can be provided directly to the anolyte by line 197 through port 191, as needed by the user. The port 191 can therefore act both as a diluent port and as a VMS port depending on the position of the valve 193. The controller 189 can be used to control the dosing parameters. For example it may control the amount of diluent to be added directly to the anolyte, or the amount of diluent to be added to VMS. It may also control the dosing of diluted or concentrated VMS to the anolyte as well as bleed and feed parameters.

Other plating apparatus configurations that control anolyte composition through addition of diluent to the anolyte are also within the scope of this invention.

Figure 2:
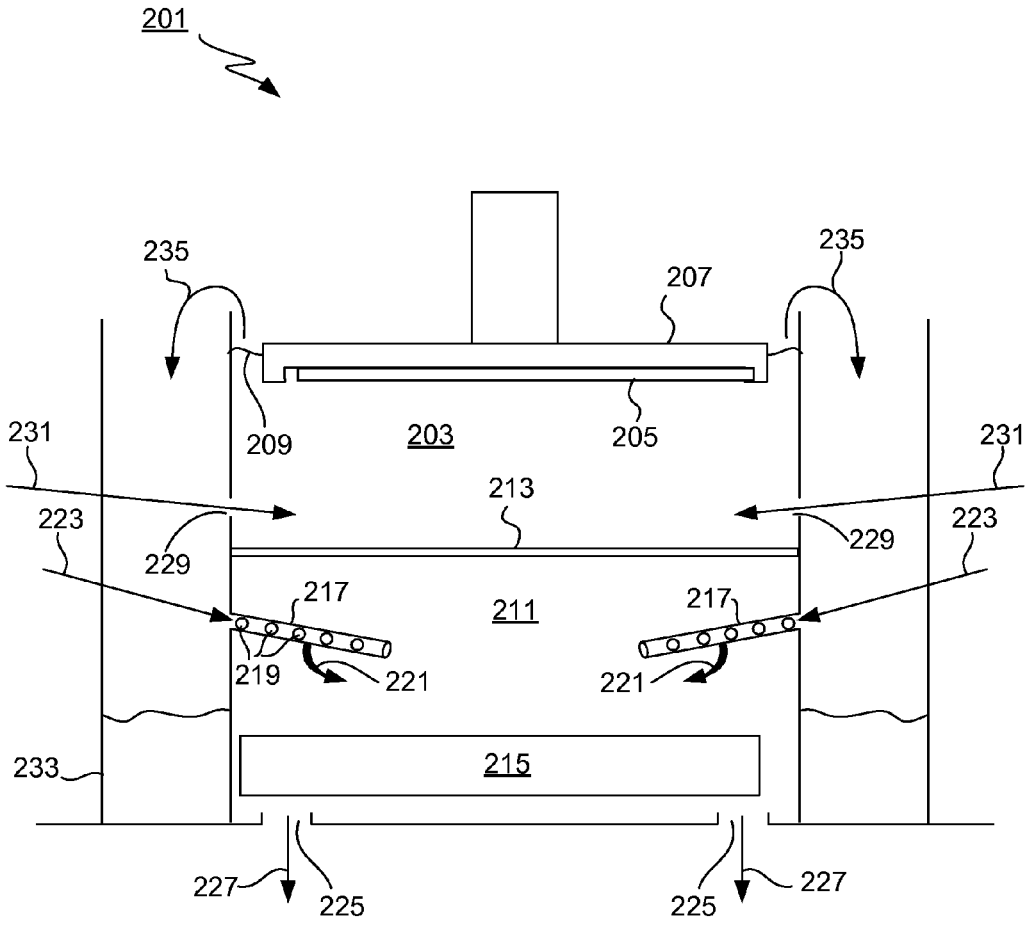
FIG. 2 presents a sectional view of the plating cell illustrating anolyte and catholyte entry and exit ports in accordance with one embodiment of the present invention.

A number of engineering designs can be used in order to introduce anolyte and catholyte into the plating apparatus. For example, manifolds having multiple openings can be used as catholyte and anolyte entry and exit ports. Manifolds compare favorably to single-opening ports, since a better mixing of anolyte and catholyte components can be achieved, and large gradients of the component concentrations within individual chambers can be avoided. One example of an engineering design involving manifolds is illustrated in FIG. 2. FIG. 2 presents a cross-sectional schematic view of an electroplating apparatus 201. The catholyte portion 203 of the plating apparatus 201 is adapted for receiving wafers in a catholyte. A wafer 205 is held by a wafer-holding fixture 207 and is immersed into catholyte shown at a level 209. The catholyte portion of the plating apparatus is separated from the anode chamber 211 by a membrane 213, so that ionic communication exists between anolyte in the anode chamber and the catholyte in the plating bath. An anode 215 is disposed within the anode chamber.

The anolyte flowing from the anolyte recirculation loop is introduced to the anode chamber 211 through flute like structures 217 having multiple openings 219. The flow of the anolyte in the anode chamber is shown by arrows 221. Arrows 223 show the direction of anolyte flow provided from the anolyte recirculation loop to the flute-like structures 217. In this embodiment, the flute-like structures essentially constitute an anolyte entry manifold serving to facilitate mixing and flow of anolyte over the anode. The anolyte exits the anode chamber and enters the anolyte recirculation loop through openings 225 of the anolyte exit manifold as shown by arrows 227. The anolyte exit manifold in this embodiment has multiple ports (such as openings 225) around the perimeter of the SAC chamber floor.

The catholyte may enter the plating bath through catholyte entry manifold so that the catholyte flowing from the catholyte recirculation loop enters the catholyte portion of the plating cell through openings 229 in the side wall of the plating bath, as shown by arrows 231. In this embodiment, the catholyte entry manifold is located around the perimeter of the plating bath wall and provides catholyte to the plating bath through catholyte entry ports, such as openings 229. The catholyte may exit the plating bath into the catholyte recirculation loop by overflowing from the plating bath into the catholyte reservoir 233, as depicted by arrows 235. The reservoir 233 corresponds to the catholyte loop reservoir 155 of FIG. 1A. For clarity, anolyte and catholyte bleed structures are not shown in FIG. 2.

Figure 3:
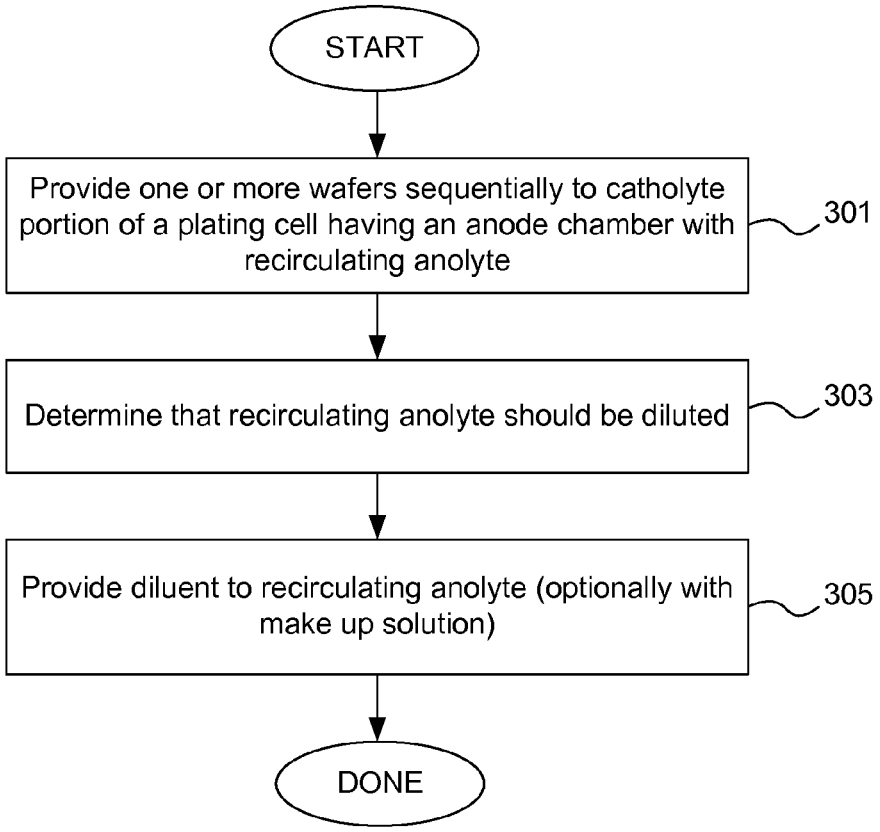
FIG. 3 is an exemplary process flow diagram illustrating electrolyte composition control method in accordance with the present invention.

FIG. 3 presents an example of a process flow that may be used for controlling the composition of anolyte. First, in an operation 301, one or more wafers are provided sequentially to a catholyte portion of a plating apparatus with recirculating anolyte. For example, an apparatus depicted in FIGS. 1A or 1B can be used.

Next, it is determined whether the anolyte should be diluted, as shown in operation 303. The determination may be based on a number of factors. Accurate predictions of anolyte composition can be made, based on simulations of anolyte concentrations, as will be described in further detail in the Examples section. It may be deduced from these simulations, that the anolyte should be diluted after certain intervals of time, in order, for example, to keep the metal salt from precipitating in the anolyte. In another example, the anolyte will be diluted after a certain amount of plating has occurred. For example, the diluent may be added to the anolyte after a certain number of wafers have been plated, or a certain number of coulombs have passed through the wafers. The determination to add a diluent may also be made based on monitoring the condition of anolyte. For example, pH of the anolyte and concentration of copper salt in the anolyte may be monitored.

After it has been determined that a diluent should be added, the diluent can be directly or indirectly provided to the anolyte. For example, the diluent may be added to the make up solution, so that a diluted make up solution is introduced to the anolyte. The diluent may also be added without make up solution directly to the anolyte via a diluent port or other port, depending on the configuration of apparatus. Any ratio of diluent to make up solution can be specified and used.

The anolyte composition can be additionally controlled by bleed and feed method. The apparatus is preferably configured, so that bleed and feed rates can be controlled independently of diluent dosing to the anolyte. In certain embodiments, the bleed from the anolyte is not discarded, but is reintroduced to the catholyte recirculation loop. Depending on the needs, the user can control whether to discard the anolyte bleed to the anolyte drain or to recirculate the used anolyte in the catholyte loop.

Analogously to the method of anolyte control, the catholyte composition may be controlled via dosing of diluent and make up solution to catholyte. The catholyte bleed and feed rates may also be controlled independently of catholyte diluent dosing. In one embodiment, the loss of water through evaporation from catholyte is also user-controlled. The dosing of components to catholyte can be performed after certain intervals of time or after certain amount of plating (number of wafers or coulombs passed). The dosing may also be initiated as a response to changes in catholyte composition, as determined by monitoring of the catholyte composition. For example, experimentally measured concentrations of copper salt, acid and chloride ions in the catholyte can be used for adjusting the catholyte dosing schedule.

Most typically, but not necessarily, deionized water is used as a diluent for controlling both anolyte and catholyte composition. In other embodiments, other diluents, such as weak acid solutions, or very dilute solutions of copper salt, may be used. It should be noted that, in general, anolyte and catholyte diluents need not necessarily be identical.

In the preferred embodiment of present invention, both the anolyte and catholyte contain an acidic solution of copper salt. For example, a solution of copper sulfate and sulfuric acid can be used. The plating solution may also include additives that modulate the rate of electrodeposition in various recesses of the wafer (organic additives or chloride ions). A typical composition of plating solution will include copper ion at a concentration range of about 0.5-80 g/L, preferably at about 5-60 g/L, and more preferably at about 18-55 g/L and sulfuric acid at a concentration range of about 0.1-400 g/L. Low-acid plating solution typically contains from about 5 to about 10 g/L of sulfuric acid. Medium and high-acid solutions contain sulfuric acid at concentrations of about 50-90 g/L and 150-180 g/L respectively. The chloride ion may be present both in the anolyte and in the catholyte in a concentration range of about 1-100 mg/L. Organic additives should preferably be present only in catholyte, so that anodic decomposition of additives is avoided. A number of organic additives, such as Enthone Viaform, Viaform NexT, Viaform Extreme (available from Enthone, West Haven, Conn.), or other accelerators, suppressors and levelers known to those of skill in the art, can be used. Make up solution provided to the anolyte and catholyte typically contains copper salt, acid, and, optionally, chloride ions. In a specific example a low acid make up solution may contain copper ion at a concentration of about 40 g/L, sulfuric acid at a concentration of about 10 g/L and chloride at a concentration of about 50 mg/L. In another example, a medium acid make up solution may contain copper ion at a concentration of about 50 g/L, sulfuric acid at a concentration of about 80 g/L and chloride at a concentration of about 50 mg/L. The composition of make up solution provided to the anolyte and catholyte may be identical or different, depending on the needs of the plating process. In some processes, the make up solution provided to the anolyte is diluted, while the make-up solution provided to the catholyte is concentrated.

The methods of anolyte and catholyte control will be herein illustrated by several examples. The user can vary several parameters of the plating cell in order to control the composition of the electrolyte in the plating cell. These parameters include the dosing of diluent and make up solution to anolyte, dosing of diluent, make up solution, and additives to the catholyte, as well as bleed and feed rates for catholyte and anolyte. All of these parameters can be either manually or automatically controlled. Further, the user can choose a cationic exchange membrane with a desired selectivity and can adjust the evaporation rate of the diluent from the catholyte.

In one embodiment, the user manually specifies dosing parameters using a control panel of a controller. The vendor will provide recommended dosing ranges for safe operation of the plating cell, so that undesired plating regimes are not entered. These ranges should be used, for example, in order to avoid building excessive pressure across the cationic exchange membrane and in order to avoid regimes that result in precipitation of copper salt in the anolyte or catholyte.

In one example of anolyte dosing, both VMS and DI water can be added to the anolyte. DI water can be added either alone (DI Water Only dosing) or together with VMS solution (VMS dosing). In the provided example, the VMS dosing is time-controlled, and DI Water Only dosing is amperometrically controlled. Both types of dosing can be used in one process. During VMS dosing, parameters specified by the user include total volume to be added to anolyte, volume percentage of VMS in the total volume to be added and frequency of dosing. For example, a VMS dosing with total volume of 1000 mL at 25% vol. VMS having a 24 hour frequency means that 750 mL of DI water and 250 mL VMS will be added to the anolyte loop every 24 hours. The recommended ranges for VMS dosing, in one example, include 0-2000 mL total volume, 10-100% vol. VMS, and a frequency of 0.1-36 hours.

The dosing of DI Water Only in this embodiment is used in order to compensate for electroosmotically lost water, and is amperometrically controlled. The user can specify the following dosing parameters: the total amount of DI water to be dosed to anolyte per ampere per hour of processing in the plating cell, and the minimum deficit volume that initiates DI water dosing. The appropriate ranges for these parameters are 0-10 mL/A·hour and 50-100 mL respectively.

In order to provide appropriate dosing parameters for the plating processes, it is useful to calculate concentrations of anolyte components for a variety of dosing schedules. These calculations can show the dynamics of copper and acid concentrations in the anolyte over a prolonged time (e.g. 30 days), and can be used to verify if particular plating parameters provide a suitable plating regime. For example, these calculations can be used to determine whether copper salt would precipitate in the anolyte, if a particular dosing schedule is used. Several examples of these simulations are provided in Table 1. Table 1 shows calculated concentrations of copper sulfate and sulfuric acid in the anode chamber (columns 8 and 9 respectively) for different plating scenarios. The common conditions of these processes include the membrane with the same selectivity (10H:1Cu), the same medium acid VMS source composition (50 g/L $Cu^{2+}$-80 g/L $H_2SO_4$–50 mg/L $Cl^-$), and the same number of wafers plated (1000 wafers per day). The differing parameters include evaporation volume, bleed and feed rate, frequency of VMS dosing, total volume of a single VMS dose, a volume percent of VMS in a VMS dose, and location of the anolyte bleed exhaust. Note that simulations presented in Table 1 do not include the DI Water Only schedule.

TABLE 1

Calculated composition of anolyte based on mass balance model.

| Scenario | Evaporation (L) | Bleed and Feed (%) | Frequency (hours) | Total Volume (L) | VMS Vol. (%) | Exhaust Location | $CuSO_4$ g/L | $H_2SO_4$ g/L |
|---|---|---|---|---|---|---|---|---|
| 1 | 0 | 10 | 24 | 1 | 100 | Drain | 93 | 12 |
| 2 | 0 | 10 | 24 | 0.5 | 50 | Drain | 47 | 7 |
| 3 | 0.66 | 10 | 24 | 1 | 50 | Catholyte | 47 | 7 |
| 4 | 0 | 5 | 2.4 | 0.1 | 25 | Drain | 40 | 6 |

Precipitation of copper sulfate occurs when its concentration exceeds 70 g/L. Referring to scenario 1, 1 L of undiluted VMS is added to the anolyte every 24 hours. It can be seen, that calculated concentration of copper sulfate in this scenario significantly exceeds the solubility limit of the salt. It can be therefore concluded that the set of parameters shown in scenario 1 will lead to copper salt precipitation and should not be selected by the user. Parameters used in scenarios 2-4 all employ diluted VMS for VMS dosing and all result in acceptable values of copper concentration in the anolyte. It has been concluded by analyzing a number of simulated scenarios that for medium acid chemistry and 10% bleed and feed rate, dosing with 0.5-1 L of 50% VMS provides adequate results. At a lower 5% bleed and feed rate, higher dilution is needed, and 0.5-1 L doses of 25% VMS should be preferably used. Evaporation of catholyte may be sometimes necessary, especially in those cases when anolyte bleed is provided to the catholyte recirculation loop.

In another embodiment, the anolyte or catholyte control system may have a feedback that can be used to set or adjust the dosing schedule. Process variables are monitored and provided to control algorithm which uses monitored variable values as feedback for adjusting delivery of one or more of diluent to anolyte, make up solution to catholyte, and bleed and feed rate for anolyte. Process variables that might be monitored include concentrations of electrolyte (catholyte and/or anolyte) components (e.g., concentrations of acid, copper salt, chloride or organic additives), as well as density, conductivity and other properties of electrolyte. The total volume of electrolyte in the plating bath can also be monitored. For example, a response can be triggered if the total volume of electrolyte exceeds 170 L, or the capability of the plating system. It is also possible to monitor the pressure differential across the cationic exchange membrane, and initiate a response after the pressure gradient exceeds a certain value.

Although various details have been omitted for clarity's sake, various design alternatives may be implemented. Therefore, the present examples are to be considered as illustrative and not restrictive, and the invention is not to be limited to the details given herein, but may be modified within the scope of the appended claims.

What is claimed is:

1. A method of controlling the composition of an electrolyte bath for electroplating a metal onto a wafer, the method comprising:

providing one or more wafers sequentially to a catholyte portion of a plating cell having a separate anode chamber configured for holding an anode and maintaining an anolyte in ionic communication with the catholyte via a cation exchange membrane on the separate anode chamber;

recirculating the anolyte;

providing a diluent to the recirculating anolyte and providing a make-up solution to the recirculating anolyte, while separately controlling delivery of the diluent and of the make up solution to the recirculating anolyte, wherein the dosing parameters for the diluent and the make up solution are selected such as to minimize precipitation-induced passivation of the anode.

2. The method of claim 1, wherein providing a diluent to recirculating anolyte comprises providing the diluent directly to recirculating anolyte via a diluent port.

3. The method of claim 1, further comprising recirculating used anolyte in a catholyte recirculation loop.

4. The method of claim 1, wherein providing a make up solution to the recirculating anolyte comprises providing the make up solution directly to the recirculating anolyte via a make up solution port.

5. The method of claim 1, wherein providing a diluent to the recirculating anolyte comprises:

providing the diluent to the make up solution to dilute the make up solution to produce diluted make up solution; and providing the diluted make up solution directly to the recirculating anolyte.

6. The method of claim 5, wherein providing a diluent to the recirculating anolyte further comprises providing a diluent directly to the recirculating anolyte.

7. The method of claim 1, further comprising bleeding and feeding anolyte from the recirculating anolyte.

8. The method of claim 1, further comprising determining that the recirculating anolyte should be diluted following a preset schedule for diluting the anolyte.

9. The method of claim 8, wherein the preset schedule comprises diluting the anolyte after a defined number of wafers have been processed.

10. The method of claim 1, further comprising receiving an amperometric and/or temporal signal and controlling the delivery of the diluent and the make up solution in response to said signal.

11. The method of claim 1, wherein the make up solution and the diluent are provided to the anolyte in a defined ratio.

12. The method of claim 1, further comprising providing a diluent and a make up solution directly to the catholyte.

13. The method of claim 1, further comprising recirculating the catholyte.

14. The method of claim 13, further comprising bleeding and feeding the recirculating catholyte.

15. The method of claim 1, wherein the diluent is water.

16. The method of claim 1, wherein the diluent consists essentially of water and an acid.

17. The method of claim 1, wherein the cation exchange membrane comprises an ionomer, and wherein the membrane provides different selectivities for transfer of protons and metal cations.

18. The method of claim 17, wherein the cation exchange membrane comprises Nafion.

19. The method of claim 1, wherein the plated metal is copper.

* * * * *